US007509820B2

(12) United States Patent
Wang

(10) Patent No.: US 7,509,820 B2
(45) Date of Patent: Mar. 31, 2009

(54) LATCH-TYPE NEEDLE FOR STITCH-FORMING TEXTILE MACHINE

(75) Inventor: Zhiyong Wang, Albstadt (DE)

(73) Assignee: Groz-Beckert KG, Albstadt (DE)

( * ) Notice: Subject to any disclaimer, the term of this patent is extended or adjusted under 35 U.S.C. 154(b) by 94 days.

(21) Appl. No.: 11/889,423

(22) Filed: Aug. 13, 2007

(65) Prior Publication Data

US 2008/0034806 A1 Feb. 14, 2008

(30) Foreign Application Priority Data

Aug. 11, 2006 (EP) ..... 06016765

(51) Int. Cl.
*D04B 35/04* (2006.01)
*D04B 35/06* (2006.01)

(52) U.S. Cl. ..... 66/120; 66/121; 66/123

(58) Field of Classification Search ..... 66/119, 66/120, 121, 122, 123
See application file for complete search history.

(56) References Cited

U.S. PATENT DOCUMENTS 885,150 A * 4/1908 Foster ..... 66/24
2,667,770 A * 2/1954 Sirmay ..... 66/95
4,580,419 A * 4/1986 Vincoli ..... 66/123
4,612,786 A * 9/1986 Perotti ..... 66/121
4,646,542 A * 3/1987 Tenconi ..... 66/24
6,298,693 B1 10/2001 Schaffer
6,807,831 B2 * 10/2004 Roth ..... 66/123

FOREIGN PATENT DOCUMENTS

| | | | |
|---|---|---|---|
| DE | 28 47 972 | A1 | 3/1980 |
| DE | 30 18 699 | A1 | 12/1980 |
| DE | 31 45 708 | A1 | 8/1982 |
| DE | 34 01 874 | A1 | 7/1985 |
| DE | 42 31 015 | A1 | 3/1993 |
| DE | 199 05 668 | A1 | 8/2000 |

* cited by examiner

*Primary Examiner*—Danny Worrell
(74) *Attorney, Agent, or Firm*—Fitch, Even, Tabin & Flannery; Norman N. Kunitz

(57) ABSTRACT

Referring to a rehanging needle, the shaft is provided with a cutout that receives the tip of a rehanging spring. The cutout is divided into a first section and a second section, whereby the two sections have different depths. When a half stitch slides onto the rehanging spring, the spring tip can use the space due to the recessed second section and sink into said space, without the rehanging spring experiencing a permanent deformation. Consequently, it is possible for the half stitches to consistently and reliably slide up in order to set up the rehanging operation.

12 Claims, 4 Drawing Sheets

LATCH-TYPE NEEDLE FOR STITCH-FORMING TEXTILE MACHINE

CROSS REFERENCE TO RELATED APPLICATION

This application claims the priority of European Patent Application No 06 016 765.0, filed on Aug. 11, 2006, the subject matter of which, in its entirety, is incorporated herein by reference.

BACKGROUND OF THE INVENTION

The invention relates to a knitting machine needle for a stitch-forming machine, in particular for a knitting machine, for the production of flat textile material.

In order to produce knit material with a pattern, for example, it is possible to use knitting machines with latch-type needles and/or slider needles. Consistent with the pattern, individual stitches are transferred from one knitting machine needle to another knitting machine needle. To achieve this, the needles, which are referred to as transfer needles or rehanging needles, comprise special stitch transfer elements.

Document DE 199 05 668 A1 has disclosed such rehanging needles are configured as latch-type needles. Such a latch-type needle opens and closes the interior hook space by means of a tongue that is mounted so as to be pivotable about a tongue slit. It has, on one of its flat sides, a stitch transfer element in the form of a rehanging spring. In order to allow an adjacent needle or oppositely arranged needle to able to take up a stitch it moves along the needle base body over the rehanging spring and, in so doing, said stitch is expanded. In order to ensure this operation, the needle base body has a rounded pocket into which immerses the tip of the rehanging spring, so that the stitch can slide onto the rehanging spring without being impaired. A lateral bias of the rehanging spring imparted by the stitch that is sliding on or by the (knitted) material that is being drawn off causes the tip of the rehanging spring to move back and forth in the rounded pocket in longitudinal direction of the needle. In doing so, there is the risk that the rehanging spring will be permanently bent, thus potentially causing the tip to no longer immerse completely into the pocket of the needle base body. A tip of the rehanging spring located outside the pocket impairs the stitch transfer operation. The projecting tip may impair the stitch or half stitch as it is sliding on. The half stitch may be speared by the tip.

Document DE 42 31 015 C2 has disclosed knitting machine needles that are rehanging needles configured as slider needles, which have a slider extending in longitudinal direction through its shaft in order to open and close a hook supported by said shaft. A rehanging spring is laterally attached to the slider needle, whereby said spring defines an intermediate space with the needle shaft, through which space the hook and the shaft of another knitting machine needle may pass. Only one end of the rehanging spring is attached to the needle body. The other end of the rehanging spring is tapered and sinks into a needle pocket provided in the needle base body. Consequently, it is possible for a half stitch to slide—starting at the hook's interior space, as the knitting machine needle is being driven out—over said needle's shaft and the rehanging spring, whereby the half stitch is expanded. As a result of this enlargement of the stitch loop of the half stitch, in conjunction with the tensile force due to the goods being drawn off, a load is applied to the rehanging spring, causing said spring to brace itself with its spring tip against the bottom of the needle pocket. The force that acts on the rehanging spring causes the spring tip to move in the direction of the needle hook, whereby the size of the intermediate space existing between the rehanging spring and the needle base body is minimally reduced. The load that is applied in the region of the tip of the rehanging spring as a result of the impacting force of the half stitch and the goods being drawn off may be large enough to cause the rehanging spring to be severely bent, so that the tip is no longer completely received by the spring pocket. This may have the result that the tip of the rehanging spring will spear the half stitch when it is supposed to slide over the needle base body. Consequently, the half stitch will no longer slide onto the rehanging spring. If the tip of the rehanging spring is lifted far enough for the half stitch to slide through under the tip of the rehanging spring, a rehanging of a stitch is no longer possible. Then, the reliable rehanging of the knitted goods is no longer ensured.

Additional rehanging needles are known from documents DE-OS 28 47 972 A1 and DE-OS 30 18 699. All the rehanging needles disclosed therein have a cutout in the base body, whereby the tip of the rehanging spring immerses into said cutout. In all cases, the bottom of the cutouts is flat, whereby a few individual cutouts have a rounded end. When a load is applied to the rehanging spring of the disclosed rehanging needles in the direction of the flat side of the needle base body, there is the risk that the shape of the rehanging spring will permanently change and that, consequently, the rehanging operation is hindered. This risk is particularly great in the case of a rehanging needle in accordance with DE-OS 30 18 699 because this rehanging spring is a so-called draw-in spring. When the needle is retracted into the needle channel, the rehanging spring is pressed flat against the needle body by the channel strip. This represents a particularly high stress on the rehanging spring.

Considering this, it is the object of the invention to develop rehanging needles with which the rehanging process is ensured over the longest possible period of time. It is the objective of the invention to improve the useful life of such rehanging needles.

SUMMARY OF THE INVENTION

This object is achieved with a rehanging needle in accordance with claim 1.

The rehanging needle in accordance with the invention has, on its lateral side that is configured as a flat side, a rehanging spring, whereby said spring's one end is connected—preferably on its one side—with the base body of the rehanging needle. Said spring forms an intermediate space with the base body of the needle, whereby a hook of another needle may sink into said intermediate space in order to take over a half stitch. On its one end, the rehanging needle has a stitch-forming region that comprises a hook and a closing element associated with said hook, this being configured, e.g., in the form of a tongue or a slider. The other end of the rehanging needle comprises at least one means for the back-and-forth movement of the rehanging needle. This moving means is preferably configured at least as a foot.

The intermediate space, into which sinks a hook of another needle for the purpose of rehanging, is limited in the direction of the moving means by attachment means of the rehanging spring on the base body of the rehanging spring. The rehanging spring may be joined to the base body of the needle in a positive-locking manner, e.g., by rivets or embossed elevations, or in a substance-locking manner, e.g., by welding or cementing. This intermediate space is bounded by a cutout in the direction of the needle hook, whereby a tongue-shaped tip of the rehanging spring sinks into said cutout. The intermediate space for receiving another needle is a closed receiving space which can be opened in the direction of the needle hook in that the elastic tip of the rehanging spring is lifted. As a rule, this is the case when the rehanging needle has grasped the half stitch to be taken over for stitch transfer and is subsequently retracted from the intermediate space.

If the rehanging needle is used to form stitches, i.e., when knitted goods are produced, in which case no stitches are rehung, the rehanging spring is in a so-called starting state. This is characterized in that the rehanging spring is mounted, in an almost load-free manner with minimal bias, to the lateral surface of the rehanging needle. Referring to a rehanging spring that is bias-mounted, the tip of the rehanging spring experiences minimal stress. In so doing, its tip abuts in the cutout of the base body of the needle and is completely received by this cutout. As a result of this, it is possible for a half stitch—without interference by the tip of the rehanging spring—to be prepared for the rehanging operation, i.e., said half stitch is being expanded. To achieve this, the half stitch slides onto the rehanging spring. In order to initiate this operation, the knitting machine needle is driven out further than is necessary for the normal stitch-forming operation.

The cutout that receives the tip of the rehanging spring in its starting state has the form of a longitudinal, preferably rectangular, pocket. Said pocket is closed along its edge and thus enclosed by a closed, preferably flat, surface. The rim of the pocket may terminate, without edge, in the flat side of the rehanging needle. As a result of this, it is ensured that, as the stitches or half stitches slide onto the base element of the needle, these stitches will not be harmed or severed. If necessary, the edge of the pocket may have small interruptions.

The lateral surfaces of the pocked terminate smoothly in the bottom of the pocked. The bottom of the pocket, which has two sections, is divided into two bottom sections. The tip of the rehanging spring abuts against the first bottom section of the pocked when said spring is in starting state. In so doing, the tip of the rehanging spring interacts with the end region of the first bottom section and defines an axial position. The second bottom section of the pocket begins directly adjoining this axial position. The depth of the first bottom section of the pocket is different from the depth of the second bottom section, preferably, it is smaller. In so doing, the depths are measured perpendicular to the flat side having the pocket and approximately in the middle of the bottom sections. These extend between the bottom sections and the flat side of the rehanging needle.

The first section of the pocket ends, and the second section of the pocket begins, on the axial position marked by the end of the rehanging spring. The transition region between the first and the second sections may be configured as an edge-free step or as a downward-sloping ramp. The transition region, which may be flat or rounded, is associated with the second section. The bottom or the bottom sections of the pocket can be aligned parallel to the flat side of the rehanging needle. The first or the second bottom section may also be arranged at a right angle with respect to the flat side. The second bottom section may be provided at an acute angle with respect to the flat side that has the pocket. Considering this arrangement at an acute angle, the angle extends between the region of the flat side—which comprises the second section—and the second bottom section. The depth of the second bottom section, extending from the axial position, increases in the direction of the hook of the knitting machine needle. The bottom sections may have different forms; they may be configured as flat surfaces, or have pan-shaped or arcuate formed surfaces. The depth of the second bottom section is greater in the region, in which the tip of the rehanging spring is in biased abutment, than at the tip of the rehanging spring when said spring is in its starting state. The depth ratios are not affected by the different forms of the bottom sections.

In view of the inventive design of the cutout, on the one hand, too much weakening of the needle shaft is avoided and, on the other hand, the tip of the rehanging spring is provided with enough room, into which the spring can move when it is pushed toward the shaft. This minimizes the deformation of the rehanging spring during the knitting operation, thus increasing its useful life.

Advantageous details of an embodiment in accordance with the invention are obvious from the drawings, from the corresponding description and/or from the subclaims.

BRIEF DESCRIPTION OF THE DRAWINGS

The drawings show in

DETAILED DESCRIPTION OF THE INVENTION

Figure 1:
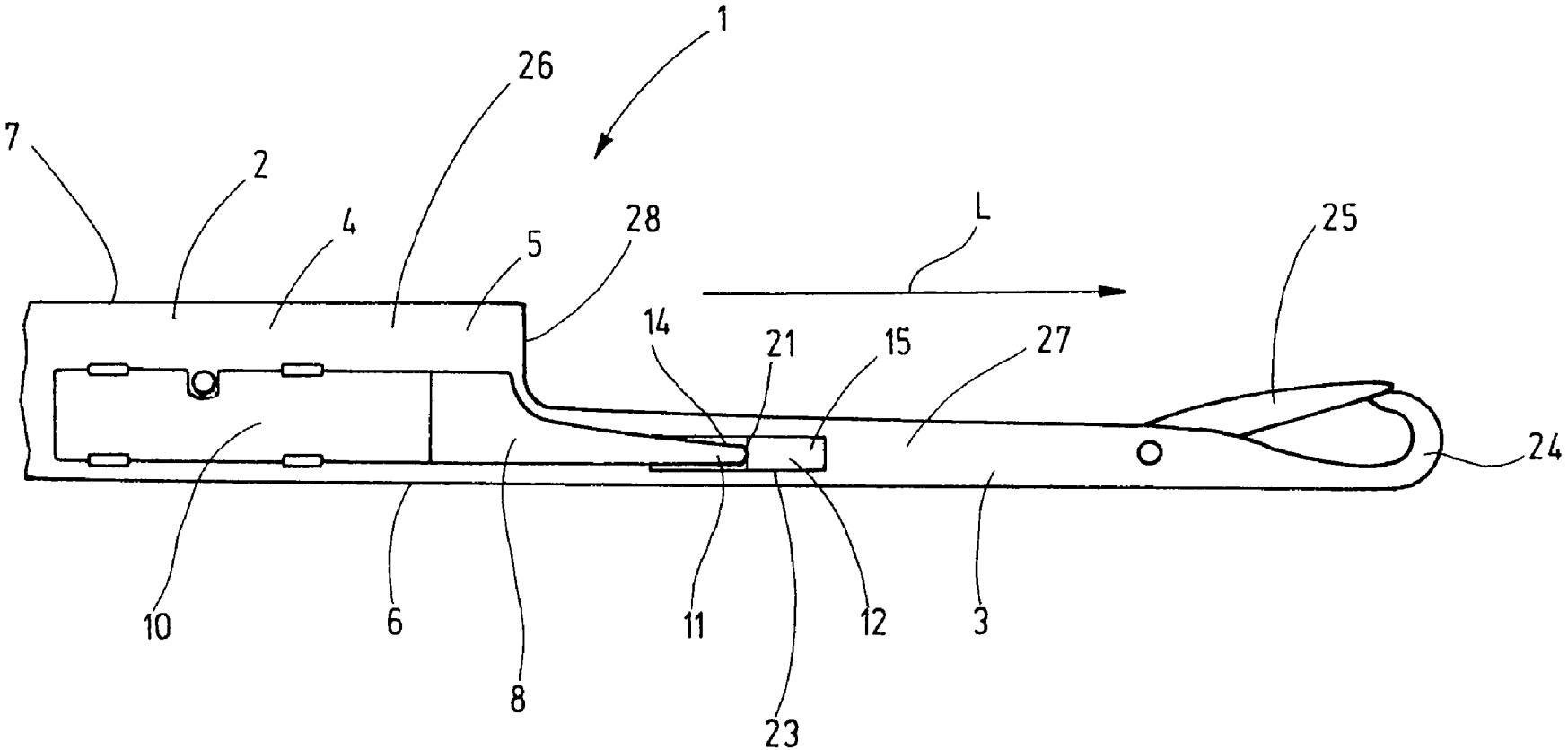
FIG. 1 a simplified and detailed illustration of a rehanging needle comprising a closing element configured as a tongue.

FIG. 1 shows the front region of a rehanging needle 1. The rear end that comprises the movement means for moving the rehanging needle 1 back and forth, is not illustrated. The rehanging needle 1 has a needle body 2, a shaft 3 and, on its end, a hook 24 with an associate closing element 25. The shaft 2 is divided into a higher section 26 and a lower section 27. Both sections 26, 27 extend upward from a common needle back 6. In the transition region from the higher section 26 of the needle body 2 to the lower section 27, the needle base body 2 has a step 28 on its upper side 7. On both sides of the step 28, the needle base body extends in a longitudinal direction L which coincides with the main direction of movement of the rehanging needle 1. Between the upper side 7 of the needle and the needle back 6 extend lateral surfaces 4 and 5, which limit the needle base body 3 in lateral direction. A rehanging spring 8 is attached to the lateral surface 4. The attachment section 10 is in the region of the high shaft section 26. The rehanging spring 8 is held on the shaft section 26 by means of known attachment means. The front region of the elastic rehanging spring 8 extends around the step 28, whereby the spring tip 11 is received by a cutout 12. The end of the spring tip 11 defines an axial position 21, which divides the cutout 12 into two sections, i.e., a first section 14 and a second section 15.

Figure 2:
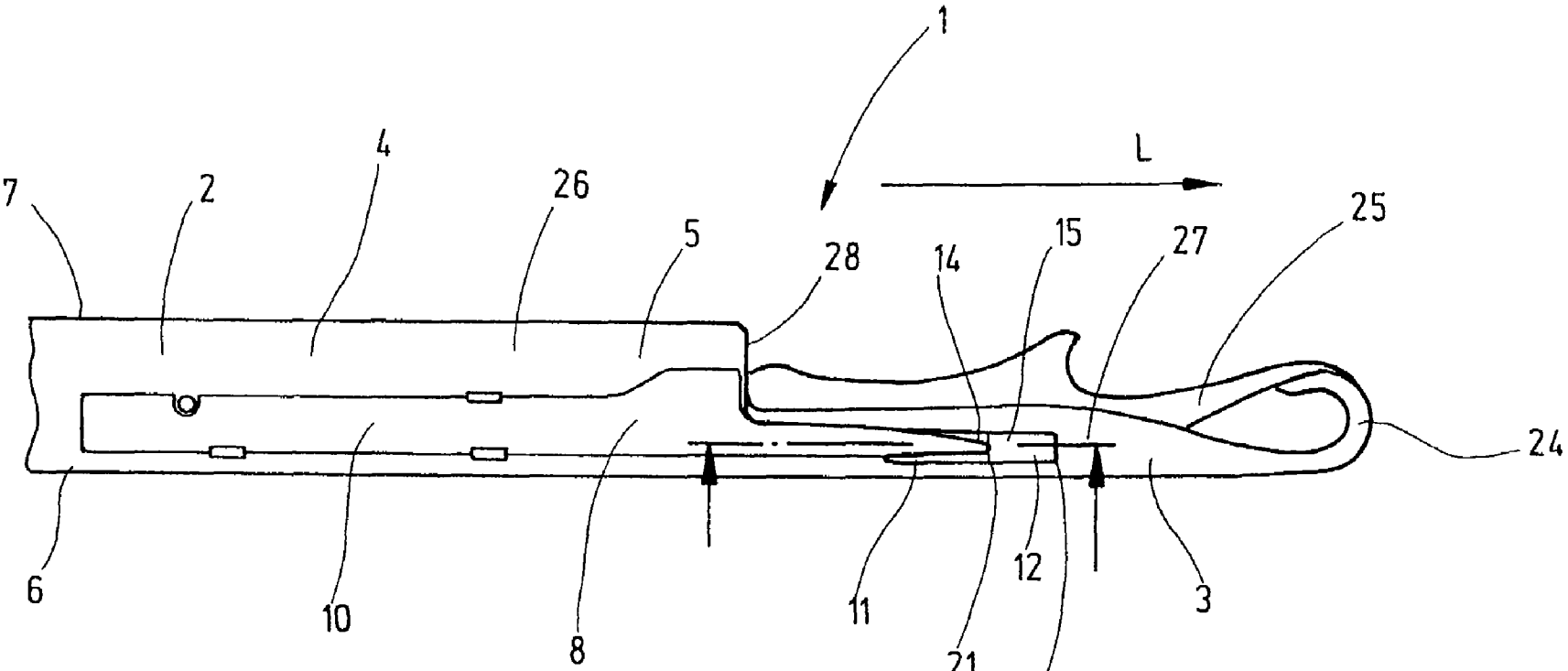
FIG. 2 a simplified and detailed illustration of a rehanging needle comprising a closing element configured as a slider.

FIG. 2 shows an inventive rehanging needle which has a slider as the closing element. Other than that, the inventive features of a rehanging needle 1 in accordance with FIG. 2 are identical to those of a rehanging needle 1 in accordance with FIG. 1. The above description applies analogously.

Figure 3:
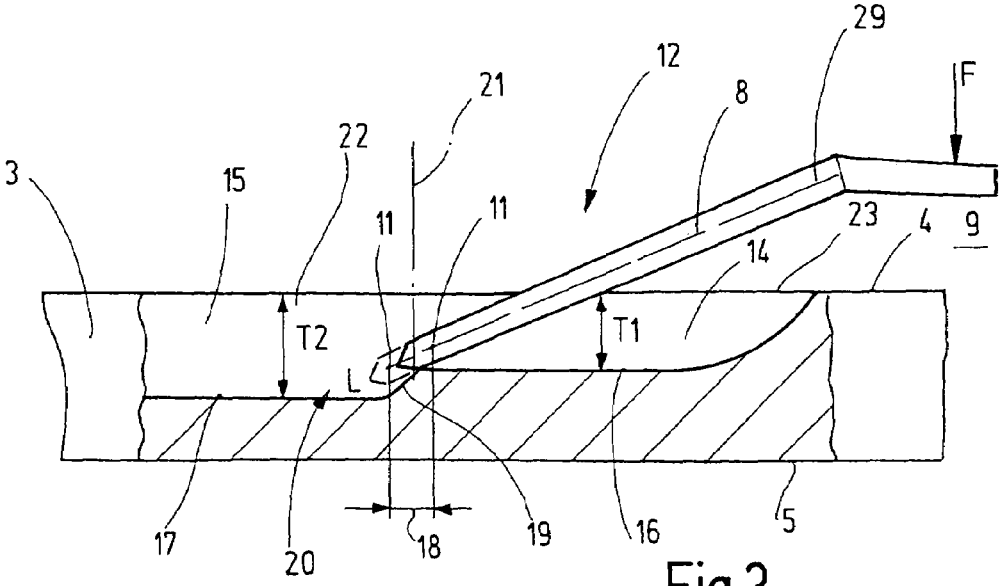
FIGS. 3, 4, 5 Sectional views of various embodiments of the cutout of a rehanging needle in accordance with FIG. 1 and FIG. 2, enlarged and in detail; and, FIG. 6 a simple perspective and detailed view of a part of a rehanging needle in accordance with FIG. 1.

FIG. 3 shows a sectional view of the cutout 12. Here, it is obvious that the cutout 12 is divided into a first section 14 and into a second section 15. Both sections 14, 15 adjoin the axial position 21 without transition. The axial position 21, against which abuts the spring tip 11 of the rehanging sprint 8—if said spring is in its starting state—is associated with the first section 14. This section 14 extends from the axial position 21 up to the terminal portion of the cutout 12 in FIG. 3 on the right side of the illustration. The terminal portion of the first section 14 is rounded and has a different shape. The edge 23 of the cutout 12 being configured as a pocket 22 terminates without edges, preferably in a rounded manner, in the lateral surface 4. This edge 23 comprises the lateral surfaces of the pocket 22 and can also be referred to as a surface edge. The second section 15 of the pocket 22 extends from the axial position 21 to the terminal portion on the left side that is not illustrated in FIG. 3. This second section 15 is associated with a transition region 18 which slightly extends into the first section 14. This transition region 18 joins together the bottom section 16 of the first section 14 to the bottom section 17 of the second section 15. In so doing, the transition region 18 has a smoothed or rounded configuration, i.e., without steps and edges. Together, the bottom section 16 and the bottom section 17 form the bottom 20 of the cutout 12. The bottom sections 16 and 17 are arranged parallel to the lateral surface 4 and 5, respectively. The transition region 18 is a part of the bottom section 17. The transition region 18 may also be configured as a downward-sloping ramp 19. This ramp connects the bottom section 16 of the first section 14 and the bottom section 17 of the second section 15. The bottom section 16 of the first section 14 has a lesser depth T1 than the bottom section 17 of the second section 16. The depths are measured perpendicular to the bottom sections 16, 17. They extend from the lateral surface 4 to the corresponding bottom section.

The spring tip 11', which is shown in dashed lines in FIG. 3, shows the position of the spring tip 11 of the rehanging spring 8 when a load is applied to said spring. In so doing, it is obvious that, due to the greater depth T2 of the second cutout 15, there is enough room in order to receive the spring tip 11' that tends to move downward due to the load that is applied in the plane of projection in accordance with FIG. 3. In so doing, it is ensured that the form of the rehanging spring 8 is ensured. When no load is applied to the rehanging spring 8, the spring tip 11 returns again into its starting position. This starting position of the spring tip 11 is shown in solid lines.

Figure 4:
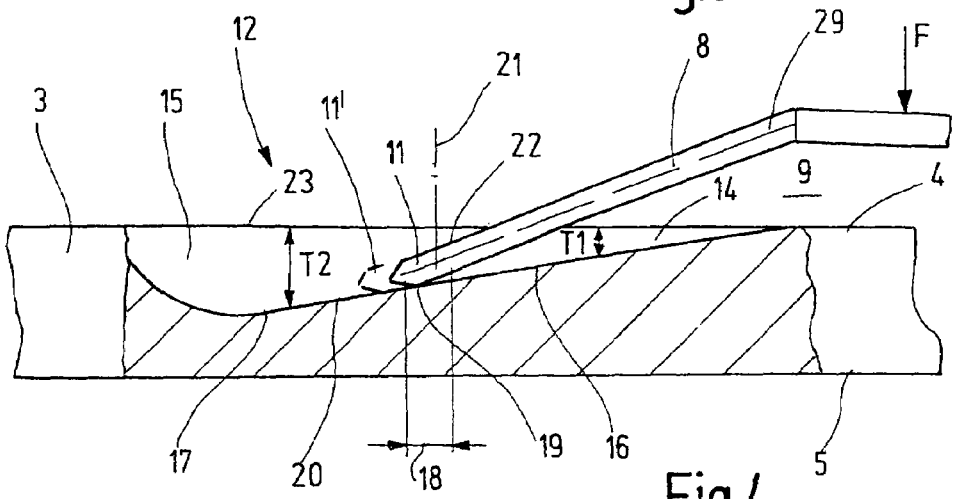

FIG. 4 shows another exemplary embodiment of the cutout 12. The identical reference numbers apply as in the above description. The bottom section 16 of the first section 14 and the bottom section 17 of the second section 15, respectively, is arranged at an acute angle relative to the lateral surface 4. The transition region 18 in accordance with FIG. 4 represents an extension of the bottom section 16 of the first section 14 of the cutout 12. This transition region may be arranged at the same angle as the bottom section 16 relative to the lateral surface 4; however, it may also be arranged at a different angle. Preferably, said transition region is sloping downward between the first bottom section 16 and the second bottom section 17. However, it is also possible that the bottom section 16, the bottom section 17 and the transition region 18 are arranged at the same acute angle relative to the lateral surface 4. In so doing, it is important that the spring tip 11 of the rehanging spring 8 be able to change its position when a load is applied, without the occurrence of a permanent (plastic) deformation of the rehanging spring. The changed position of the spring tip 11 is indicated in dashed lines and labeled 11' in FIG. 4. The depth T2 in the region of the changed position of the spring tip 11' of the rehanging spring 8 when a load is applied is greater than the depth T1 in the region of the starting position of the spring tip 11, when the rehanging spring 8 is in its starting state.

Figure 5:
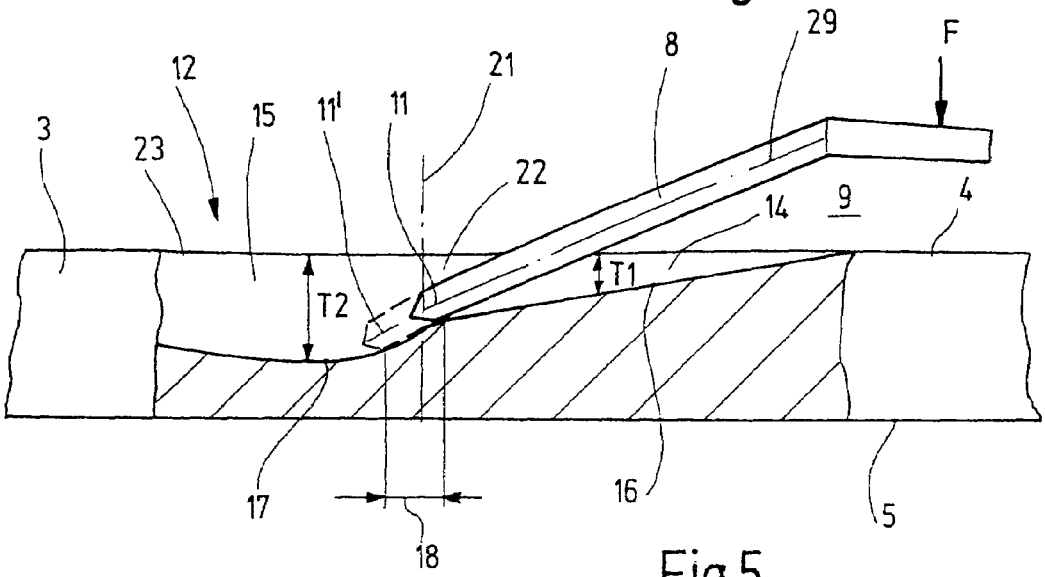
Figure 6:
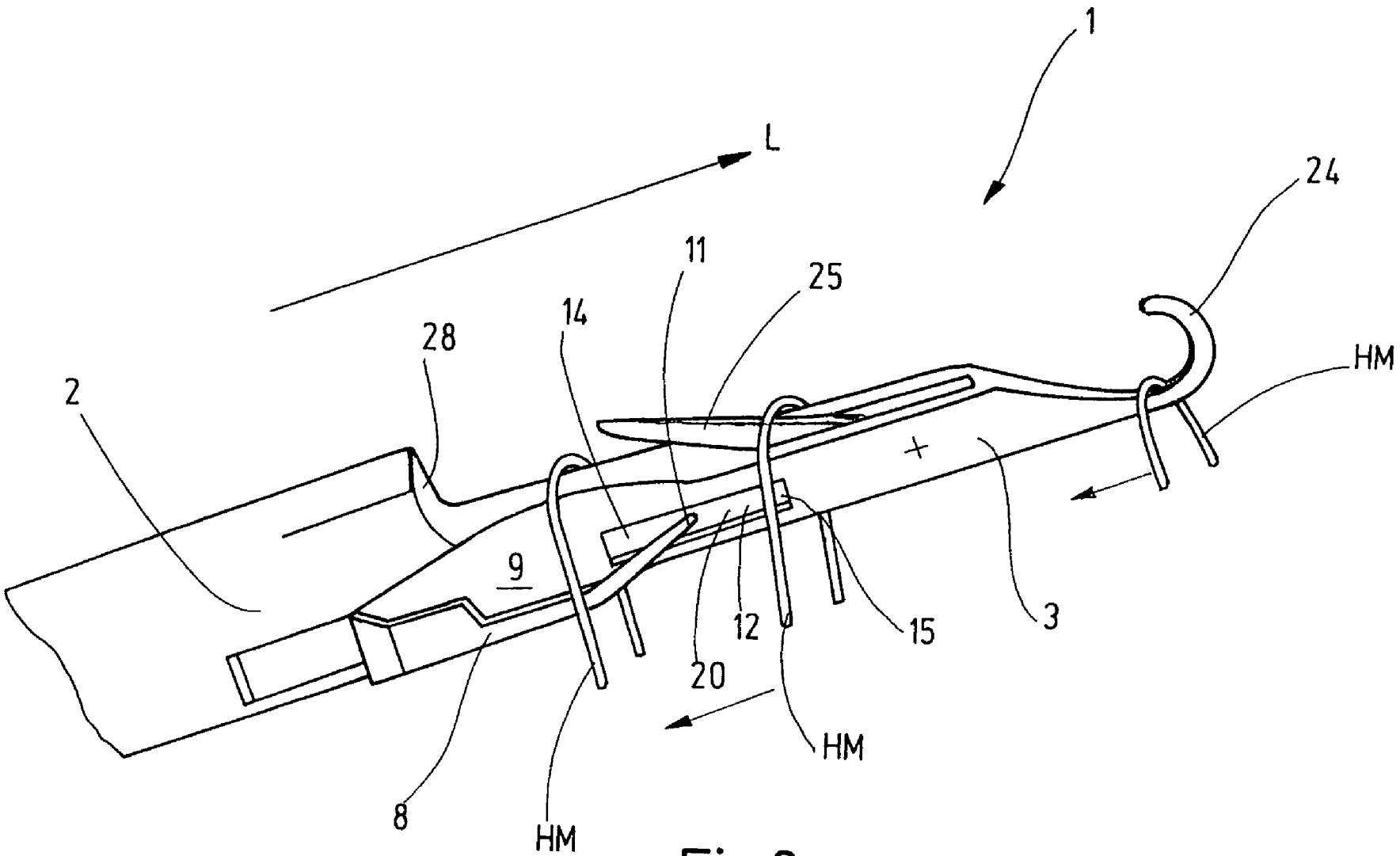

FIG. 5 shows another embodiment of the cutout 12. This embodiment differs from the above-described embodiments in that the bottom section 17 rises starting at a deepest point T2 in the direction of the end of the second section 12, i.e., at a distance from the axial position 21, and thus the depth T2 is reduced. Referring to a cutout 12 in accordance with the invention, it is decisive that the transition region 18 be configured so as to be downward-sloping, so that room for the spring tip 11 is created in the second section 15, when said spring tip extends along its center axis 29 while a load is being applied to the rehanging spring 8.

FIG. 3 illustrates the function of the rehanging needle 1. In order to transfer the half stitches HM, which have been grasped by the hook 24 of the rehanging needle 1 and which are located in said hook's internal hook space, the rehanging needle 1 is driven out in longitudinal direction L. In so doing, the half stitch HM slides along the needle shaft 3—whereby the closing element 25 is opened—over the shaft 3 and beyond the closing element 25 up to step 28. Inasmuch as the spring tip 11 is received by the cutout 12, it does not hinder the half stitch HM from sliding. The half stitch HM is expanded by the rehanging spring 8 projecting from the needle base body 2, so that another needle, which sinks into the intermediate space 9 between the needle base body 2 and the rehanging spring 8, can pick up the expanded half stitch HM. As the half stitch HM is being expanded, a force is applied to the rehanging spring 8 in the direction of the arrow F (FIGS. 3, 4, 5). The result is that the spring tip 11 moves in the direction of its center axis 29 and assumes the position 11' (FIGS. 3, 4, 5). The additional space made available by an inventive cutout 12 offers the tip 11 of the rehanging spring 8 sufficient free space in order to change its position consistent with the applied force F. Consequently, it is ensured that the rehanging spring 8, in particular its tip 11, does not experience any permanent deformations which hinder the half stitches HM from sliding onto the needle shaft 3. If the expanded half stitch HM is in the region of the step 28, another needle may sink into the intermediate space 9 between the needle base body 2 and the rehanging spring 8 and catch the half stitch HM with its hook. The rehanging operation is completed by the retraction of the rehanging needle 1 that has originally carried the half stitch HM. By completely retracting the rehanging needle 1, the half stitch HM is transferred to the other needle and is located in its interior hook space.

Referring to a rehanging needle 1, the shaft 3 is provided with a cutout 12 that receives the tip of a rehanging spring 8. The cutout 12 is divided into a first section 14 and a second section 15, whereby the two sections have different depths T1, T2. When a half stitch HM slides onto the rehanging spring 8, the spring tip 11 can use the space due to the recessed second section and sink into said space, without the rehanging spring 8 experiencing a permanent deformation. Consequently, it is possible for the half stitches HM to consistently and reliably slide up in order to set up the rehanging operation.

LIST OF REFERENCE NUMBERS

1 Rehanging needle
2 Needle body
3 Shaft
4, 5 Lateral surface
6 Needle back
7 Upper side 7 of the needle
8 Rehanging spring
9 Intermediate space
10 Attachment section
11 Spring tip
12 Cutout
14 First section
15 Second section
16, 17 Bottom section

18 Transition region
19 Ramp
20 Bottom
21 Axial position
22 Pocket
23 Edge, surface edge
24 Hook
25 Closing element
26 High shaft section
27 Low shaft section
28 Step
29 Center axis
L Longitudinal direction
HM Half stitch
F Force
T1, T2 Depth

The invention claimed is:

1. Rehanging needle for stitch-forming machines, comprising:

a needle body having a longitudinal shaft with lateral surfaces, a needle back and an upper side of the needle, a rehanging spring held on one lateral surface the shaft, said spring having, on its one end, an attachment section and, on its other end, a spring tip, whereby said spring defines an intermediate space with the shaft, a pocket formed in said one lateral surface and into which the spring tip extends, and wherein the pocket has a first section with a bottom surface that is abutted by the spring tip when the spring is unloaded, and a second section, which extends forwardly from the first section and has a bottom surface that is abutted by the spring tip when the spring is loaded toward the one lateral surface, and the depth of the first section is less than the depth of the second section.

2. Rehanging needle in accordance with claim 1, wherein the pocket has a closed edge.

3. Rehanging needle in accordance with claim 2, wherein the edge of the pocket is bounded by the lateral surface.

4. Rehanging needle in accordance with claim 2, wherein the edge of the pocket is continuous.

5. Rehanging needle in accordance with claim 1, wherein the first section and the second section of the pocket terminate in each other in a transition region in an axial position, in which the spring tip ends.

6. Rehanging needle in accordance with claim 5, wherein the transition region is configured in an edge-free and/or rounded manner.

7. Rehanging needle in accordance with claim 5, wherein the transition region, starting at the first section of the pocket, terminates in a downward-sloping manner in the second section of the pocket and/or is configured as a ramp.

8. Rehanging needle in accordance with claim 5, wherein the transition region is configured as a flat surface.

9. Rehanging needle in accordance with claim 1, wherein the bottom surface of the first section and of the pocket is arranged parallel to, or at an acute with respect to, the one lateral surface.

10. Rehanging needle in accordance with claim 1, wherein the bottom surface of the second section of the pocket is arranged parallel to, or at an acute angle with respect to, the one lateral surface.

11. Rehanging needle in accordance with claim 1, wherein the depth of the second section of the pocket is not constant.

12. Rehanging needle in accordance with claim 11, wherein the depth of the second section increases, starting at an axial position, at which the spring tip ends, and away from the attachment section of the rehanging spring.

* * * * *